United States Patent [19]

Hesse

[11] Patent Number: 4,981,181

[45] Date of Patent: Jan. 1, 1991

[54] RAM BORING MACHINE FOR LAYING SERVICE LINES WITHOUT EXCAVATION

[75] Inventor: Alfons Hesse, Lennestadt, Fed. Rep. of Germany

[73] Assignee: Paul Schmidt, Lennestadt, Fed. Rep. of Germany

[21] Appl. No.: 387,335

[22] Filed: Jul. 28, 1989

[30] Foreign Application Priority Data

Sep. 1, 1988 [DE] Fed. Rep. of Germany ..... 3829628

[51] Int. Cl.[5] ..... E21B 11/09; F16L 1/00

[52] U.S. Cl. ..... 175/19; 405/154

[58] Field of Search ..... 175/19, 62; 173/90, 173/91; 405/154

[56] References Cited

U.S. PATENT DOCUMENTS

| | | | |
|---|---|---|---|
| 4,662,457 | 5/1987 | Bouplon | 175/19 X |
| 4,674,916 | 6/1987 | Wayman et al. | 405/154 |
| 4,738,565 | 4/1988 | Streatfield et al. | 405/154 |
| 4,789,268 | 12/1988 | Yarnell | 405/154 |
| 4,809,789 | 3/1989 | MacFarlane | 175/19 X |
| 4,871,034 | 10/1989 | Schmidt | 405/154 X |

FOREIGN PATENT DOCUMENTS

| | | |
|---|---|---|
| 2157259 | 11/1972 | Fed. Rep. of Germany . |
| 2634066 | 2/1978 | Fed. Rep. of Germany . |

*Primary Examiner*—William P. Neuder

*Attorney, Agent, or Firm*—Toren, McGeady & Associates

[57] ABSTRACT

A ram boring machine for laying service lines in the ground without excavation, having a striking piston axially displaceable in a tubular housing and driven by means of a pressure medium via a supply hose connected to the housing, in which the supply hose is connected to the front end of the housing in the direction of advance and does not obstruct work on new pipes pushed into the passage made in the ground or drawn in simultaneously by the ram boring machine.

6 Claims, 2 Drawing Sheets

RAM BORING MACHINE FOR LAYING SERVICE LINES WITHOUT EXCAVATION

TECHNICAL FIELD OF THE INVENTION

The invention relates to a ram boring machine for laying service lines in the ground without excavation, having a striking piston axially displaceable in a housing and driven by means of a pressure medium via a supply hose.

BACKGROUND OF THE INVENTION AND PRIOR ART

Such ram boring machines in which the automatic striking piston applies periodic ramming blows on a moveable impact tip or on the machine housing are known, for example from German Patent Specifications Nos. 21 57 259 and 26 34 066. The ram boring machines serve primarily to lay service lines such as, for example, gas and water lines, electricity or telephone lines or cables under roadways or sidewalks without the need to tear up the surface of the roadway or the sidewalk at the same time. As the ram boring machine moves through the ground it forces the soil aside and leaves behind it a passage into which a service line can be simultaneously or subsequently drawn. Such a ram boring machine can therefore be connected at its rear end to a coupling for fastening a follower pipe, or alternatively a pipe to be laid can be pulled into the passage in the ground by the ram boring machine using a tow rope.

It is known from German Patent Specification No. 28 24 915 to use such ram boring machines for the destructive replacement of old lines, for example comprising iron or ceramic pipes. For this purpose the impact tip of the machine is provided with cutting edges or impact knives that project radially outwards. As the impact tip of the ram boring machine moves forwards the cutting edges burst the old pipe line. In this case too a follower pipe coupled to the housing or held by a tow rope can be pulled simultaneously in one operation into the ground. Common to all the numerous ram boring machines known is that they are supplied by a compressed air hose connected to the rear end of the housing and having its other end connected to a compressed air source, which may be very remote. This leads to problems particularly if the piping used is in the form of many short pipes put together, as is particularly common in drainage engineering when laying or replacing drain pipes, and not of long continuously welded pipe strings as, for example, in the case of laying or replacing gas pipes.

Such short pipes, which are often not more than a meter long, can either be pushed into the passage in the ground with a pressure driving unit or—as disclosed in German Patent No. 26 11 677—can be pulled in behind a steel cable. The compressed air hose, which then runs through the pipe to be pulled in and is coupled to the rear end of the machine housing, is however extremely disadvantageous and requires troublesome additional measures to be taken because assembled pipes of steel and plastics material are welded at their joints. To avoid damage by the heat generated when welding the compressed air hose must not be in the pipe being drawn in, and must be uncoupled and pulled out of the pipe before each welding operation. Plastics material pipes are as a rule heated with the aid of a thermal shield inserted into the pipe, which must therefore have a through bore for the compressed air hose, and are then pressed together.

The individual pipe strings or short pipe must—in order to avoid uncoupling the hose each time—be threaded on to the compressed air hose. A pressure driving press must have a bore allowing the compressed air hose to be passed through it. The hose must also be uncoupled in order to be able to put the pressure driving unit into position.

OBJECT OF THE INVENTION

It is an object of the invention to avoid the afore-mentioned disadvantages when laying pipes, in particular short pipe strings, in the ground without excavation.

SUMMARY OF THE INVENTION

According to the invention the supply hose is connected to the front end of the housing in the direction of advance. By this surprisingly simple measure, which differs from all known ways of operating or of supplying the striking piston of a ram boring machine with a pressure medium, all the afore-mentioned problems are solved in one go. The supply hose runs quasi in front of the ram boring machine and can thus no longer have disturbing effects behind the machine or obstruct the necessary work there.

In the case of a ram boring machine having a conical head part at the leading end of the housing it provides an easier way of introducing the machine into an old pipe to be renewed or into a passage in the ground.

It is advantageous if the head part is formed as a connection piece tapered in the direction of advance and overlapping the supply hose. The conical head part, which is either in one piece, i.e. merging into a connection piece without transition, or one provided with a connection piece screwed into it, then offers, aside from improved guiding properties, protection to the supply hose which is enclosed by the connection piece over part of its length corresponding to the length of the connection piece.

With a striking piston that is preferably stepped and has a piston extension extending in the direction of advance and having a plurality of control openings corresponding to control openings secured to the housing, the forward and backward movement of the striking piston can be controlled so that the piston always strikes the machine housing and/or the machine tip on its side facing the hose connection piece and imparts its impact energy there.

A transverse bore preferably arranged in a necked middle section of the piston extension can be connected to a longitudinal bore leading into a working chamber behind the piston. In this way the control openings can be connected to one another by appropriate arrangement of the control edges so that after a particular backward stroke of the striking piston the compressed air arrives behind the striking piston and accelerates it in the direction of advance, i.e. forwards again, and vice versa.

The supply hose can advantageously be attached to a control pipe which is surrounded by a piston jacket of the striking piston provided with control openings and has through it an air passage leading into a piston bore. In this way a striking piston in its front end position is, on supplying air via the middle passage of the control pipe, first moved to the right, i.e. counter to the direction of advance, until the control openings of the piston jacket are connected to the piston bore. Thereafter compressed air can arrive via the piston bore and the control openings behind the striking piston and introduce a new working cycle in the direction of advance.

BRIEF DESCRIPTION OF THE DRAWINGS

The invention will now be explained in more detail with reference to exemplary embodiments shown in the drawings, in which.

DETAILED DESCRIPTION OF PREFERRED EMBODIMENTS OF THE INVENTION

Figure 1:
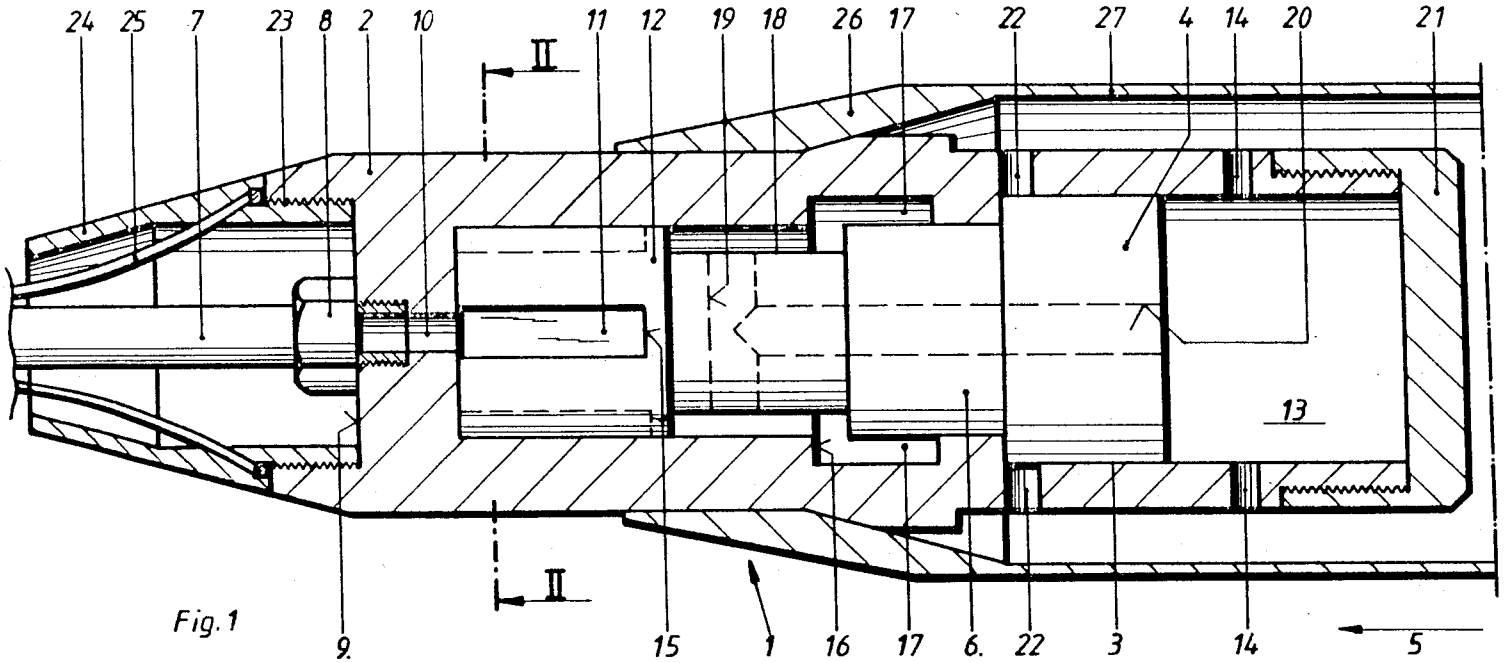
FIG. 1 shows a longitudinal section through a ram boring machine having a supply hose according to the invention connected to the machine head at the front.

The ram boring machine 1 has a housing 2 in which a striking piston 3 can be axially displaced. The striking piston 3 is formed as a stepped piston and has a main piston 4 and a piston extension 6 of smaller diameter extending in the direction of advance 5 of the ram boring machine 1. In the position shown the striking piston 3 is in its front end position.

Figure 2:
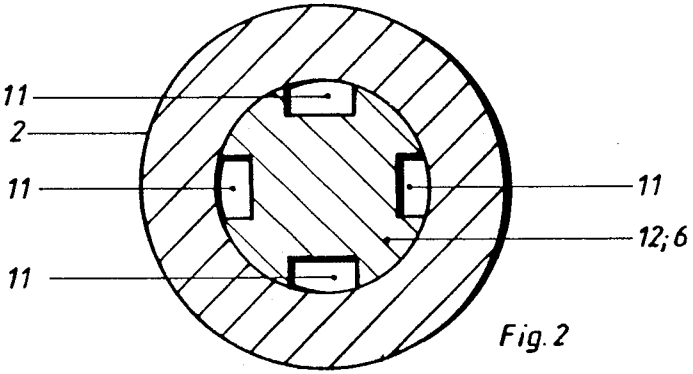
FIG. 2 shows the ram boring machine show in FIG. 1 sectioned along the line II—II.

Attached by means of a hose connection piece 8 to the front end of the housing 2 in the direction of advance 5 is a compressed air hose 7 connected to a compressed air source (compressor) (not shown). A longitudinal bore 10 passing through the front end wall 9 conducts compressed air supplied via the compressed air hose 7 to the front face of the piston extension 6, which is provided with a control head 12 having air grooves 11 (see FIG. 2) distributed on the periphery. Because the compressed air acts on the front face of the control head 12 the striking piston 3 is displaced counter to the direction of advance 5, i.e. to the right, and the air enclosed in a working chamber 13 behind the main piston 4 escapes via air openings 14 towards the back until control edges 15 of the air grooves 11 (see FIG. 1) overlap corresponding control edges 16 of radial control openings 17 in the machine housing 2. The compressed air supplied by the hose 7 then arrives, via the grooves 11 in the control head 12 and the control openings 17 secured to the housing, in a transverse bore 19 arranged in a necked middle section 18 of the piston extension 6 and via a longitudinal bore 20 connected thereto (the bores 19 and 20 are shown in broken lines in FIG. 1) into the working chamber 13 behind the main piston 4.

The working chamber 13 is bounded at the back by a cover 21 screwed on to the rear end of the housing. As soon as a pressure exceeding the counter pressure in the working chamber 13 has built up the striking piston 3 is accelerated back into its position shown and the air in front of the main piston 4 escapes to the back via air openings 22.

The front end of the ram boring machine 1 is provided with a lead cone 23 and in addition a connection piece 24 tapered in the direction of advance 5 screwed into the lead cone 23 and extending it like a funnel. The connection piece 24 overlaps part of the length of the compressed air hose 7 and thus acts as a hose protection. A tow rope 25 inserted before screwing on the connection piece 24 and fixed between the connection piece 24 and the lead cone 23 serves to guide the ram boring machine 1 moving through an old pipe (not shown) or a passage in the ground (not shown); the tow rope 25 can be pulled in a target trench, for example by a winch, so that in addition the forward stroke of the ram boring machine 1 can be increased. Furthermore, pushed on to the housing 2 is a widening connection piece 26, conically tapered in the direction of advance 5, which has a skirt 27 extending backwards beyond the rear end of the ram boring machine 1. A pipe can be slid on between the skirt 27 and the machine housing 2 and be drawn into the ground as the ram boring machine 1 advances.

Figure 3:
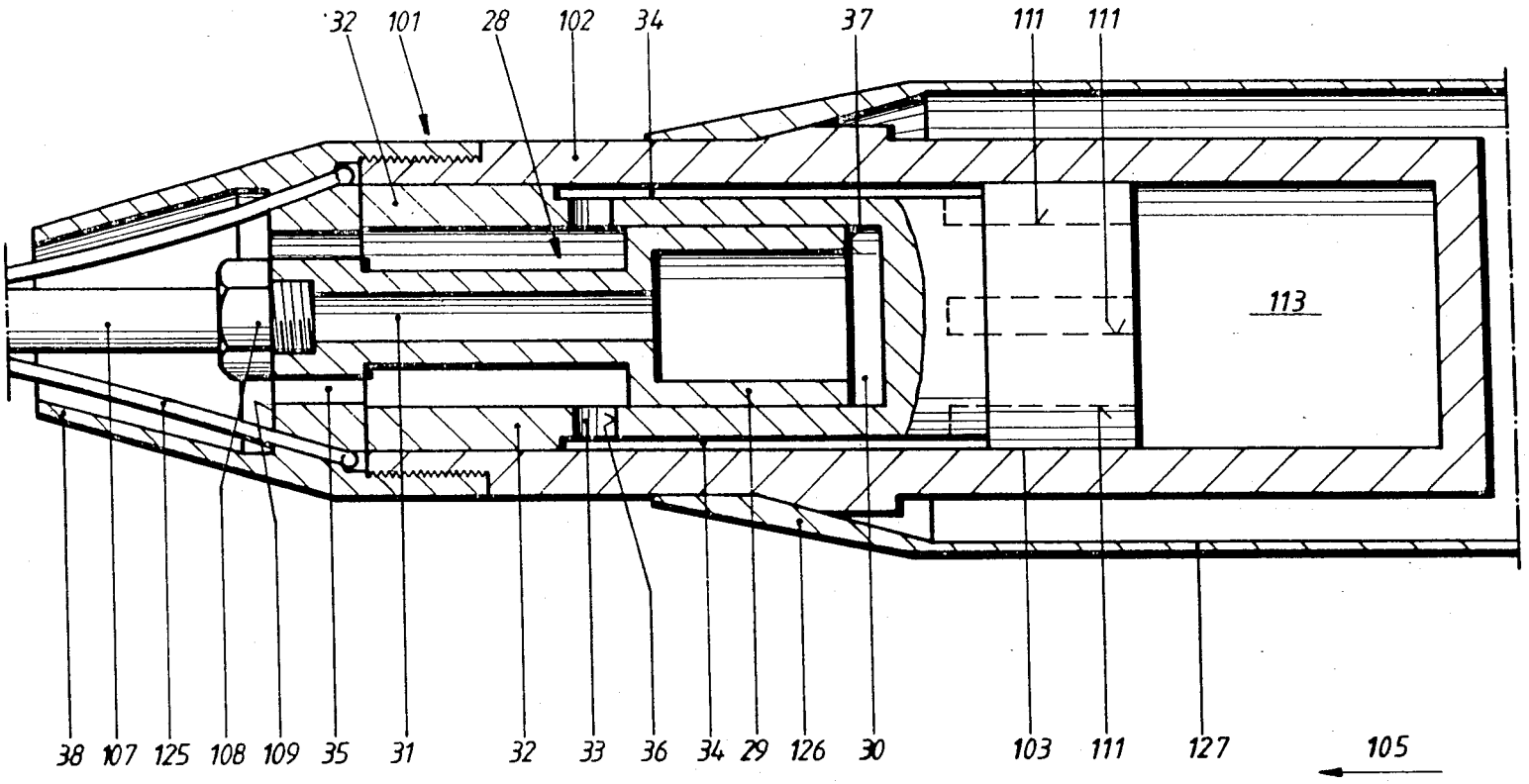
FIG. 3 shows a longitudinal section through another embodiment of a ram boring machine according to the invention.

In the ram boring machine 101 shown in FIG. 3, at the front end of the housing 102 a pressure medium hose 107 having a hose connection piece 108 is attached to a control pipe 28 fixed in the housing 102. The end of the control pipe 29 remote from the hose connection piece 108 is formed as a head part 29 which engages snugly in a piston bore 30 of a striking piston 103. The compressed air hose 107 is connected to the piston bore 30 by way of an air passage 31 passing centrally through the control pipe 28. The piston skirt 32 that slides over or on the control pipe head part 29 has radial control openings 33 which merge into axial air passages 34; the passages 34 lead to air grooves 111 (shown in broken lines) distributed peripherally in the striking piston 103.

In order to move the striking piston 103 from its front end position shown into the end position opposite the direction of advance 105 pressure builds up in the piston bore 30 owing to the air supplied via the compressed air hose 107 and the air passage 31 and moves the striking piston 103 gradually further into the closed working chamber 113, i.e. to the right. The control openings 33 are arranged so that the air from the working chamber 113 behind the piston 103 can arrive without obstruction via the air grooves 111, the axial air passages 34 and the control openings 33 at the vent bores 35 in the front wall 109 of the ram boring machine 101 and escape from there into the atmosphere.

As soon as the rear control edges 36 of the control openings 33 in the piston skirt 32 (viewed in the direction of advance 105) overlap the sealing front edge 37 of the control pipe head part 29, compressed air from the piston bore 30 arrives, via the control openings 33, the air passages 34 and the air grooves 111 behind the striking piston 103, in the working chamber 13. A pressure builds up there which then accelerates the striking piston 103 in the direction of advance 105 again. Both the supply air and exhaust air escape via the vent bores 35 at the front end of the housing 102.

Screwed on to the front end of the housing 102 is a conical head part 38 overlapping the compressed air hose 107 in the direction of advance, which represents a lead cone integral with a connection piece. Enclosed between the head part 38 and the front end of the housing 102 is a tow rope 125. A widening connection piece 126 having a skirt 127 extending beyond the rear end of the ram boring machine 101 is also pushed on to the machine housing 102.

What is claimed is:

1. A ram boring machine for laying service lines in an earth trench in the ground without need for excavation, having a striking piston axially displaceable in a housing and driven by means of a pressure medium via a supply hose leading from the front end of the housing in the direction of advance, the supply hose (7, 107) being connected to a hose terminal (8, 108) arranged in a housing tip (23, 24, 28) at an end wall (9, 109) of the housing (2, 102), the supply hose being in connection with the striking piston (3, 103) by a channel (10, 31)

arranged to longitudinally pass through the end wall (9, 109).

2. A ram boring machine according to claim 1 wherein the leading end of the housing has a conical head piece.

3. A ram boring machine according to claim 2 wherein said head piece is formed as a connection piece tapered in the direction of advance and overlapping the supply hose.

4. A ram boring machine according to claim 1 wherein the striking piston is stepped and has a piston extension extending in the direction of advance and having therein a plurality of control openings corresponding to control openings secured to the housing.

5. A ram boring machine according to claim 4 wherein a transverse bore arranged in a necked middle section of the piston extension is connected to a longitudinal bore opening into a working chamber behind the piston.

6. A ram boring machine according to claim 1 wherein said supply hose is attached to a control pipe which is surrounded by a piston skirt of the striking piston that is provided with control openings and has an air passage extending into the piston bore.

* * * * *